US007729637B2

(12) United States Patent
Sato

(10) Patent No.: US 7,729,637 B2
(45) Date of Patent: Jun. 1, 2010

(54) PROCESS CARTRIDGE HAVING ELASTIC CONNECTIONS AND IMAGE FORMATION APPARATUS USING THE PROCESS CARTRIDGE

(75) Inventor: Shougo Sato, Seto (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 277 days.

(21) Appl. No.: 10/772,404

(22) Filed: Feb. 6, 2004

(65) Prior Publication Data

US 2004/0161260 A1 Aug. 19, 2004

(30) Foreign Application Priority Data

Feb. 6, 2003 (JP) ..... 2003-029651

(51) Int. Cl.
*G03G 21/16* (2006.01)
*G03G 15/01* (2006.01)

(52) U.S. Cl. ..... 399/111

(58) Field of Classification Search ..... 399/111, 399/113, 110, 107
See application file for complete search history.

(56) References Cited

U.S. PATENT DOCUMENTS

| | | | | |
|---|---|---|---|---|
| 5,142,322 | A * | 8/1992 | Surti | 399/113 |
| 5,369,479 | A * | 11/1994 | Tsuyuki | 399/113 |
| 5,565,961 | A * | 10/1996 | Shoji et al. | 399/111 |
| 5,943,528 | A * | 8/1999 | Akutsu et al. | 399/110 |
| 6,041,203 | A * | 3/2000 | Suzuki et al. | 399/111 |
| 6,311,026 | B1 * | 10/2001 | Higeta et al. | 399/13 |
| 6,330,410 | B1 * | 12/2001 | Okabe et al. | 399/113 |
| 6,636,712 | B2 * | 10/2003 | Shimaoka | 399/113 |
| 6,681,088 | B2 * | 1/2004 | Kanno et al. | 399/111 |
| 6,993,264 | B2 * | 1/2006 | Oguma et al. | 399/90 |
| 2001/0041080 | A1 * | 11/2001 | Higeta et al. | 399/103 |
| 2002/0051653 | A1 * | 5/2002 | Toba et al. | 399/111 |
| 2003/0142991 | A1 * | 7/2003 | Arimitsu et al. | 399/90 |

FOREIGN PATENT DOCUMENTS

| | | | |
|---|---|---|---|
| JP | 60140264 | A * | 7/1985 |
| JP | 62134655 | A * | 6/1987 |
| JP | 62145258 | A * | 6/1987 |
| JP | 63249158 | A * | 10/1988 |
| JP | 02213880 | A * | 8/1990 |
| JP | A-4-134458 | | 5/1992 |
| JP | 09062099 | A * | 3/1997 |
| JP | A-09-152826 | | 6/1997 |
| JP | A 2000-267380 | | 9/2000 |
| JP | A 2000-293085 | | 10/2000 |
| JP | 2001083858 | A * | 3/2001 |
| JP | A 2001-166555 | | 6/2001 |
| JP | A-2001-255777 | | 9/2001 |

OTHER PUBLICATIONS

Computer Translation for JP2001-083858A.*

* cited by examiner

*Primary Examiner*—Quana M Grainger
(74) *Attorney, Agent, or Firm*—Oliff & Berridge, PLC

(57) ABSTRACT

An image forming apparatus includes: a mainframe; a process cartridge loadable in and unloadable from the mainframe; and an exposure unit that is arranged correspondingly with the process cartridge. The process cartridge includes: a photosensitive body that is exposed by the exposure unit to form an electrostatic latent image thereon, and a processing device that acts on the photosensitive body; and relative positions of the photosensitive body and the processing device are changeable at the time the process cartridge is loaded and unloaded.

44 Claims, 4 Drawing Sheets

PROCESS CARTRIDGE HAVING ELASTIC CONNECTIONS AND IMAGE FORMATION APPARATUS USING THE PROCESS CARTRIDGE

BACKGROUND OF THE INVENTION

1. Field of the Invention

The present invention relates to an image forming apparatus that is disposed with a photosensitive body and a processing device and forms an image on a recording medium, and to a process cartridge that is disposed with a photosensitive body and a processing device and is loadable in and unloadable from an image forming apparatus mainframe.

2. Background Art

Conventionally, as a multicolor image forming apparatus that forms a multicolor image of four colors on a recording medium such as recording paper, a so-called tandem-system device is known where photosensitive bodies, exposure means that expose the photosensitive bodies to form electrostatic latent images on the surfaces of the photosensitive bodies and developing means that supply a charged developing agent to the surfaces of the photosensitive bodies on which the electrostatic latent images have been formed are respectively disposed in line in numbers corresponding to the number of colors (e.g., the four colors of magenta, cyan, yellow and black). A 4-cycle-system device is also known where there is one exposure means and one photosensitive body, with developing means being disposed around the periphery of the photosensitive body in a number corresponding to the number of colors.

Here, the latter 4-cycle system is not suited for increases in the speed of image formation because steps such as exposure and development of the photosensitive body are conducted by successively changing the colors. In contrast, with the tandem system, steps such as exposure and development of the photosensitive body can be conducted substantially simultaneously for each color, and a multicolor image can be formed by successively superposing and transferring, to the recording medium, the developing agent adhering to the photosensitive bodies corresponding to the colors. For this reason, a tandem-system multicolor image forming apparatus is suited for increases in speed because the sped of image formation is not much different from that in the case of monochromatic image formation.

In these image forming apparatuses, it is necessary to occasionally replace the photosensitive bodies and developing means. In a tandem-system multicolor image forming apparatus, because the exposure means and photosensitive bodies are respectively disposed in numbers corresponding to the number of colors, a contrivance is necessary so that, at the time of replacing the photosensitive bodies and the developing means (there are cases where these are integrally and replaceably configured as process cartridges), these do not interfere with the exposure means. Thus, evacuating the exposure means to a non-interfering position at the time of replacing the process cartridges has been considered (e.g., see JP-A-2001-166555).

However, when the exposure means are evacuated at the time of replacing the process cartridges, the position of the exposure means of each color subtly relatively moves each time replacement is conducted, so that there is the potential for this to cause color shifting.

SUMMARY OF THE INVENTION

The present invention has been devised with the object of providing an image forming apparatus with which it is possible to easily replace process cartridges, without having to evacuate the exposure unit, and a process cartridge that can be used in the image forming apparatus.

To achieve the object, the invention provides an image forming apparatus, including: a mainframe; a process cartridge loadable in and unloadable from the mainframe; and an exposure unit that is arranged correspondingly with the process cartridge. The process cartridge includes: a photosensitive body that is exposed by the exposure unit to form an electrostatic latent image thereon, and a processing device that acts on the photosensitive body; and relative positions of the photosensitive body and the processing device are changeable at the time the process cartridge is loaded and unloaded.

In the invention configured in this manner, when the process cartridge disposed with the photosensitive body and the processing device acting on the photosensitive body is loaded in and unloaded from the image forming apparatus, the relative positions of the photosensitive body and the processing device can be changed so that the process cartridge does not interfere with the exposure unit.

In this manner, because the process cartridge is loaded and unloaded while the relation positions of the photosensitive body and the processing device are changed, interference between the process cartridge and the exposure unit can be prevented and the process cartridge can be easily replaced without having to move the exposure unit. Also, assume that the invention is a so-called tandem-system multicolor image forming apparatus disposed with the exposure unit, the photosensitive body and the processing device per color, it is suited for increases in the speed of image formation and there is the effect of preventing color shifting because, as described above, the exposure unit does not have to be moved. Moreover, because interference between the process cartridge and the exposure unit is prevented as described above, there are also the effects that the degree of design freedom increases and it becomes easy to make the device compact.

The invention may provide a process cartridge loadable in and unloadable from an image forming apparatus, including: a photosensitive body; and a processing device acting on the photosensitive body; wherein relative positions of the photosensitive body and the processing device are changeable when the process cartridge is loaded in and unloaded from the multicolor image forming apparatus.

In the invention configured in this manner, the relative positions of the photosensitive body and the processing device change when the process cartridge is loaded in and unloaded from the image forming apparatus. For this reason, because the process cartridge is loaded and unloaded in the image forming apparatus while the relation positions of the photosensitive body and the processing device are changed, it becomes easy to configure the process cartridge of this invention so that it does not interfere with members such as the exposure unit of the image forming apparatus. Thus, the degree of freedom with which the image forming apparatus can be designed increases, the image forming apparatus can be made compact, and it becomes easy to prevent color shifting by not having to move the exposure unit when the process cartridge is replaced. It should be noted that the process cartridge of this invention is suited for the multicolor image forming apparatus according to the invention and is also suited for a monochromatic image forming apparatus.

BRIEF DESCRIPTION OF THE DRAWINGS

The present invention may be more readily described with reference to the accompanying drawings.

DETAILED DESCRIPTION OF THE PREFERRED EMBODIMENTS

Figure 1:
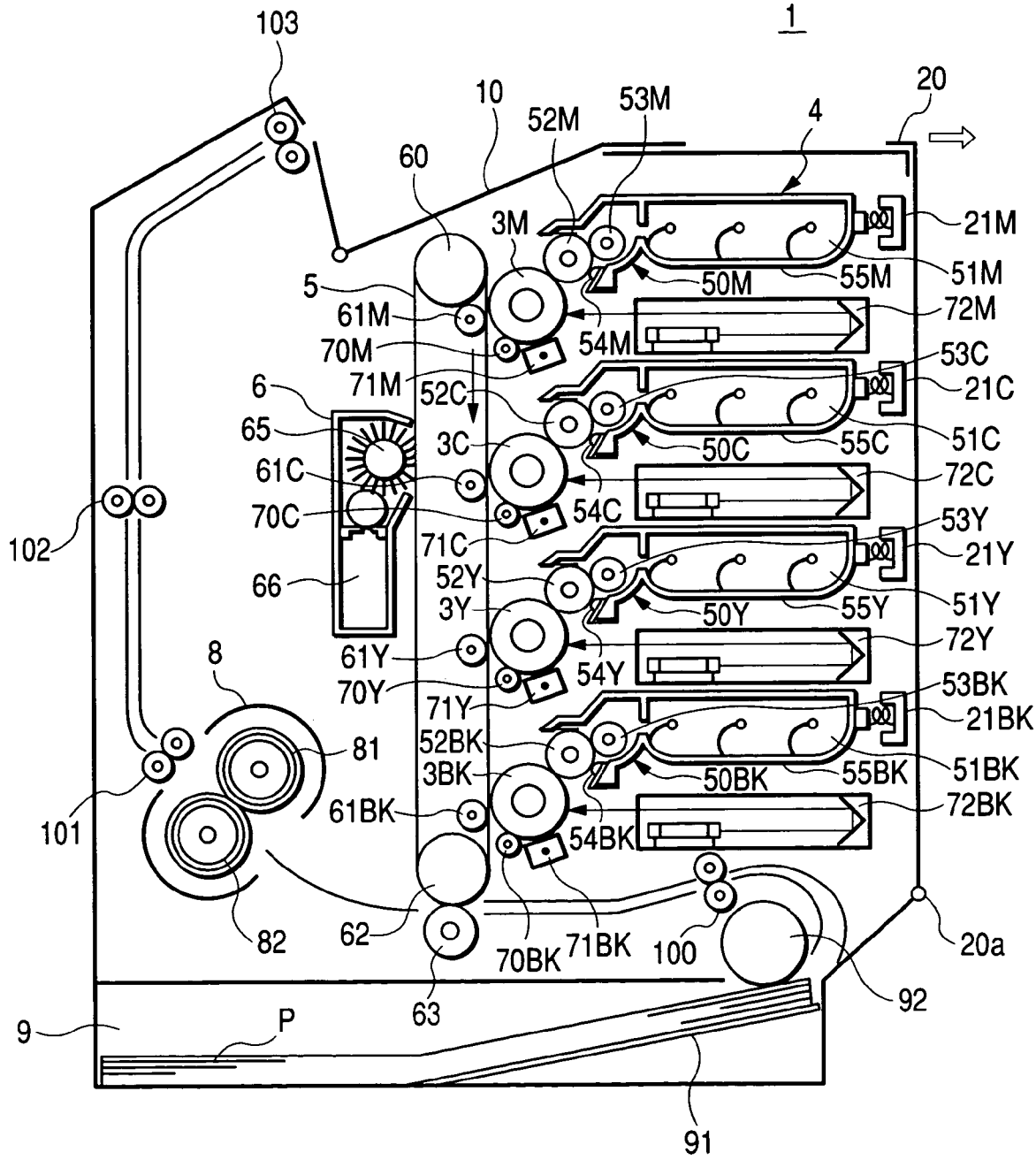
FIG. 1 is a schematic sectional side view of a color laser printer to which the invention has been applied.

Next, an embodiment of the invention will be described together with the drawings. FIG. 1 is a schematic sectional side view of a color laser printer 1 functioning as an image forming apparatus to which the invention has been applied. The color laser printer 1 exemplified in FIG. 1 is disposed with a visible image forming unit 4, a belt-like intermediate transfer body 5, a fixing unit 8, a paper supply unit 9 and a paper discharge tray 10.

The visible image forming unit 4 is disposed, per visible image step resulting from respective magenta (M), cyan (C), yellow (Y) and black (Bk) toners, with developing devices 51M, 51C, 51Y and 51Bk functioning as a developing unit, photosensitive drums 3M, 3C, 3Y and 3Bk functioning as photosensitive bodies, cleaning rollers 70M, 70C, 70Y and 70Bk functioning as cleaning units, chargers 71M, 71C, 71Y and 71Bk functioning as charging units, and exposure means 72M, 72C, 72Y and 72Bk functioning as exposure units.

These respective constituent elements will be described in detail below. First, the developing devices 51M, 51C, 51Y and 51Bk are disposed with development rollers 52M, 52C, 52Y and 52Bk. The development rollers 52M, 52C, 52Y and 52Bk are cylindrically configured with conductive silicone rubber as the base material, with a coated layer of a rubber material or resin including fluorine being formed on the surfaces. It should be noted that the base material of the development rollers 52M, 52C, 52Y and 52Bk does not invariably have to be configured by conductive silicone rubber and may also be configured by conductive urethane rubber. Additionally, the ten-point height of surface roughness (Rz) is set to 3 to 5.m and configured to be smaller than the 9.m that is the average particle diameter of the toners.

Supply rollers 53M, 53C, 53Y and 53Bk are disposed in the developing devices 51M, 51C, 51Y and 51Bk. The supply rollers 53M, 53C, 53Y and 53Bk are conductive sponge rollers that are disposed so as to press and contact, with the elastic force of the sponges, the development rollers 52M, 52C, 52Y and 52Bk. It should be noted that foam of an appropriate material, such as conductive silicone rubber, EPDM or urethane rubber, can be used as the supply rollers 53M, 53C, 53Y and 53Bk.

Layer thickness regulating blades 54M, 54C, 54Y and 54Bk are also disposed in the developing devices 51M to 51Bk. Base ends of the layer thickness regulating blades 54M, 54C, 54Y and 54Bk are formed of stainless steel in plate shapes and fixed to developing device cases 55M, 55C, 55Y and 55Bk, and leading ends of the layer thickness regulating blades 54M, 54C, 54Y and 54Bk are formed of insulating silicone rubber or insulating fluorine-including rubber or resin. The leading ends of the layer thickness regulating blades 54M, 54C, 54Y and 54Bk are pressed so as to contact the development rollers 52M, 52C, 52Y and 52Bk from below the development rollers 52M, 52C, 52Y and 52Bk.

Also, the toners accommodated in the developing device cases 55M, 55C, 55Y and 55Bk are positively-charged non-magnetic single component developing devices that include toner mother particles of an average particle diameter of 9.m comprising a well-known colorant such as carbon black and a charge-controlling resin or charge-controlling agent such as nigrosine, triphenylmethane or quaternary ammonium salt added to styrene-acrylic resin formed in spherical shapes by suspension polymerization. Additionally, the toners are configured by adding, as an external additive, silica to the surfaces of the toner mother particles. Also, a well-known hydrophobization treatment resulting from a silane coupling agent or silicone oil is administered to the silica serving as the external additive, so that the average particle diameter of the silica is 10 nm and the added amount of the silica is 0.6% by weight of the toner mother particles. Magenta, cyan, yellow and black toners are respectively accommodated in the developing device cases 55M, 55C, 55Y and 55Bk.

In this manner, the toners are suspension-polymerized toners that are extremely close to spherical shapes and have excellent fluidity because hydrophobized silica whose average particle diameter is 10 nm is added at 0.6% by weight as an external additive. For this reason, a sufficient charge can be obtained by frictional charging. Moreover, because corner portions are not present as in crushed toner, it is difficult for the toners to receive mechanical force, the toners have excellent followability with respect to an electrical field and transfer efficiency is good.

Drums where a positively-charged photosensitive layer is formed on an aluminium base material are used as an example for the photosensitive drums 3M, 3C, 3Y and 3Bk. The photosensitive layers are formed to have a thickness of 20.m or more, and the aluminium base materials are used as grounding layers. It should be noted that, in the present embodiment, there is a slight velocity differential between the intermediate transfer body 5 and the photosensitive drums 3M, 3C, 3Y and 3Bk.

The cleaning rollers 70M, 70C, 70Y and 70Bk are rollers comprising elastic bodies such as conductive sponges and are configured to frictionally slide against the photosensitive drums 3M, 3C, 3Y and 3Bk at lower portions of the photosensitive drums 3M, 3C, 3Y and 3Bk. A voltage of a negative polarity, which is the opposite polarity from that of the toner, is applied by an unillustrated power source to the cleaning rollers 70M, 70C, 70Y and 70Bk. Residual toner on the photosensitive drums 3M, 3C, 3Y and 3Bk is removed due to the action of an electrical field resulting from this voltage and the frictional force with respect to the photosensitive drums 3M, 3C, 3Y and 3Bk. It should be noted that, because a so-called cleanerless development system is used in the present embodiment, residual toner removed by the cleaning rollers 70M, 70C, 70Y and 70Bk is again returned to the photosensitive drums 3M, 3C, 3Y and 3Bk, collected by the development rollers 52M, 52C, 52Y and 52Bk and returned to the developing devices 51M, 51C, 51Y and 51Bk of each color in a predetermined cycle after the development step has ended.

The chargers 71M, 71C, 71Y and 71Bk are scorotron chargers and are disposed so as to face, without contacting, the surfaces of the photosensitive drums 3M, 3C, 3Y and 3Bk from below the photosensitive drums 3M, 3C, 3Y and 3Bk further at the rotational-direction downstream side of the photosensitive drums 3M, 3C, 3Y and 3Bk than the cleaning rollers 70M, 70C, 70Y and 70Bk.

The exposure means 72M, 72C, 72Y and 72Bk are configured by well-known laser scanners. The exposure means 72M, 72C, 72Y and 72Bk are disposed so as to be vertically in line with the developing devices 51M, 51C, 51Y and 51Bk of the visible image forming unit 4 and horizontally in line with the photosensitive drums 3M, 3C, 3Y and 3Bk and the chargers 71M, 71C, 71Y and 71Bk, and expose the surfaces of the photosensitive drums 3M, 3C, 3Y and 3Bk with laser light beams further at the rotational-direction downstream side of the photosensitive drums 3M, 3C, 3Y and 3Bk than the chargers 71M, 71C, 71Y and 71Bk. Laser light beams corresponding to image data are irradiated, by the exposure means 72M, 72C, 72Y and 72Bk, onto the surfaces of the photosensitive drums 3M, 3C, 3Y and 3Bk so that electrostatic latent images of each color are formed on the surfaces of the photosensitive drums 3M, 3C, 3Y and 3Bk.

The toners are positively charged, supplied from the supply rollers 53M, 53C, 53Y and 53Bk to the development rollers 52M, 52C, 52Y and 52Bk, and formed in uniformly thin layers by the layer thickness regulating blades 54M, 54C, 54Y and 54Bk. At the portions of contact between the development rollers 52M, 52C, 52Y and 52Bk and the photosensitive drums 3M, 3C, 3Y and 3Bk, the positively charged toners can excellently develop, in a reverse development system, the positive-polarity (positive charge) electrostatic latent images formed on the photosensitive drums 3M, 3C, 3Y and 3Bk and can form extremely high-quality images.

The belt-like intermediate transfer body 5 comprises a conductive sheet of polycarbonate or polyimide formed in a belt. As shown in FIG. 1, the belt-like intermediate transfer body 5 is wound around two drive rollers 60 and 62, and intermediate transfer rollers 61M, 61C, 61Y and 61Bk are disposed near positions at which the intermediate transfer body 5 faces the photosensitive drums 3M, 3C, 3Y and 3Bk. As shown in FIG. 1, the direction in which the surface of the intermediate transfer body 5 facing the photosensitive drums 3M, 3C, 3Y and 3Bk moves is set to be a direction in which it moves vertically downward from above.

A predetermined voltage is applied to the intermediate transfer rollers 61M, 61C, 61Y and 61Bk so that the toner images formed on the photosensitive drums 3M, 3C, 3Y and 3Bk are transferred to the intermediate transfer body 5. Also, a secondary transfer roller 63 is disposed so as to face the position at which the toner images are transferred to paper P (corresponding to a recording medium)—i.e., facing the roller 62 in a vertically low direction with respect to the intermediate transfer body 5—and a predetermined potential is also applied to the secondary transfer roller 63. As a result, the toner images of the four colors retained on the belt-like intermediate transfer body 5 are transferred to the paper P.

As shown in FIG. 1, a cleaner 6 is disposed at the side of the intermediate transfer body 5 opposite from the side at which the intermediate transfer body 5 faces the photosensitive drums 3M, 3C, 3Y and 3Bk. The cleaner 6 comprises a scraping member 65 and a case 66, uses the scraping member 65 to scrape off toner remaining on the intermediate transfer body 5 and accommodates the residual toner in the case 66.

The fixing unit 8 comprises a first heating roller 81 and a second heating roller 82, and uses the first heating roller 81 and the second heating roller 82 to nip, convey, heat and pressurize the paper P, on which the toner images of the four colors are retained, to fix the toner images to the paper P.

The paper supply unit 9 is disposed at the lowermost portion of the device, and comprises an accommodation tray 91 that accommodates the paper P and a pick-up roller 92 that feeds the paper P. The paper supply unit 9 is configured to supply the paper P at a predetermined timing with the image forming steps resulting from the exposure means 72M, 72C, 72Y and 72Bk, the developing devices 51M, 51C, 51Y and 51Bk, the photosensitive drums 3M, 3C, 3Y and 3Bk and the intermediate transfer body 5. The paper P supplied from the paper supply unit 9 is conveyed by a pair of conveyance rollers 100 to the portion where the intermediate transfer body 5 and the secondary transfer roller 63 are pressed together.

The paper discharge tray 10 is disposed at the uppermost portion of the device, at the paper discharge side of the fixing unit 8, and configured to accommodate the paper P that is discharged from the fixing unit 8 and conveyed by pairs of conveyance rollers 101, 102 and 103.

Figure 2:
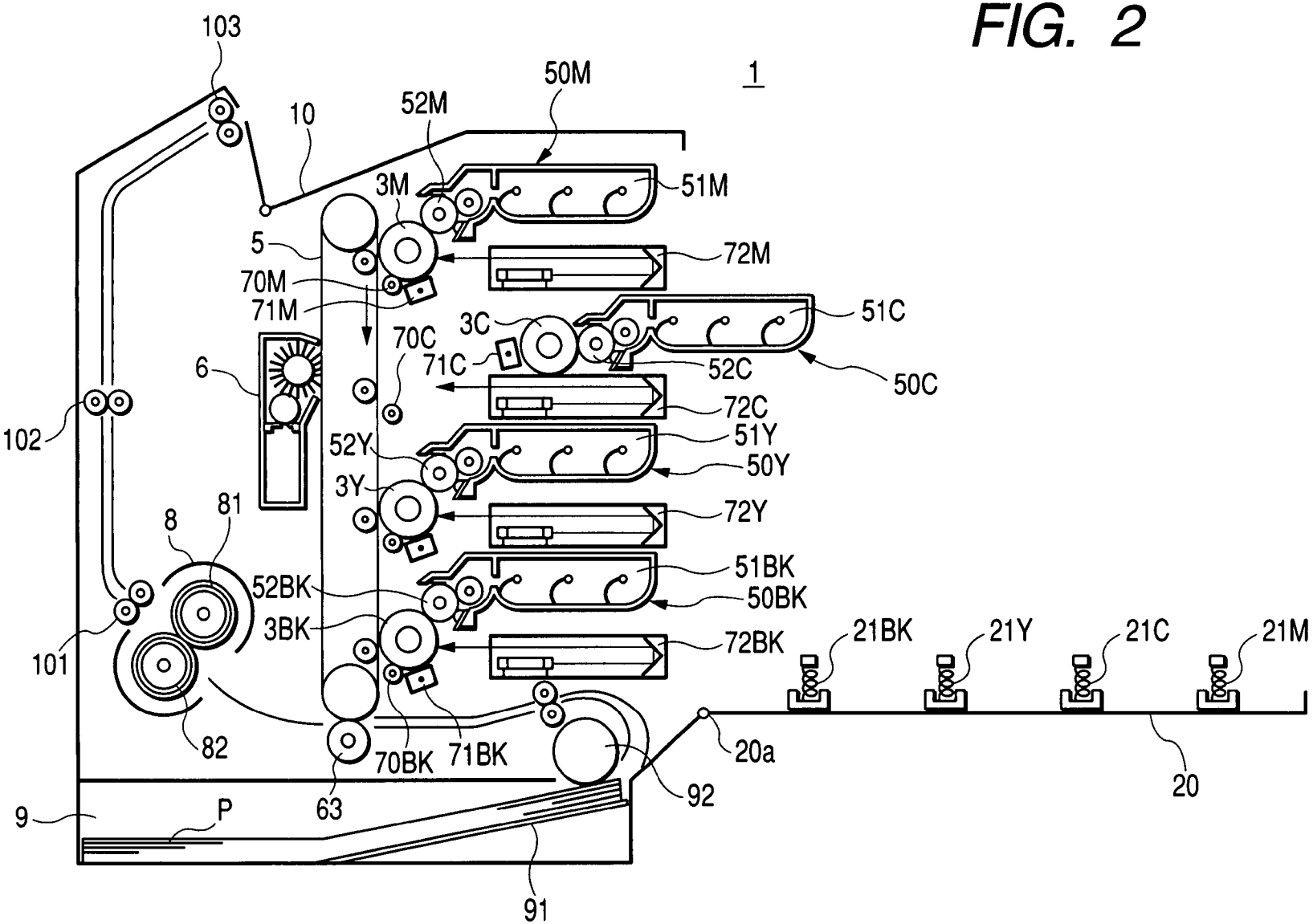
FIG. 2 is a schematic sectional side view showing the printer when a front cover thereof has been opened.

It should be noted that, in the present embodiment, as shown in FIG. 1, a front cover 20 is configured so as to be pivotable around a shaft 20*a* in the direction of the white arrow in FIG. 1. By opening the front cover 20 as shown in FIG. 2, the developing devices 51M, 51C, 51Y and 51Bk can be replaced. Here, spring members 21M, 21C, 21Y and 21Bk are disposed at left-right direction center portions of the front cover 20 that are positions at which the spring members 21M, 21C, 21Y and 21Bk face the developing devices 51M, 51C, 51Y and 51Bk. When the front cover 20 is closed, the spring members 21M, 21C, 21Y and 21Bk push the developing devices 51M, 51C, 51Y and 51Bk inward (in the leftward direction of FIG. 1).

Figure 3:
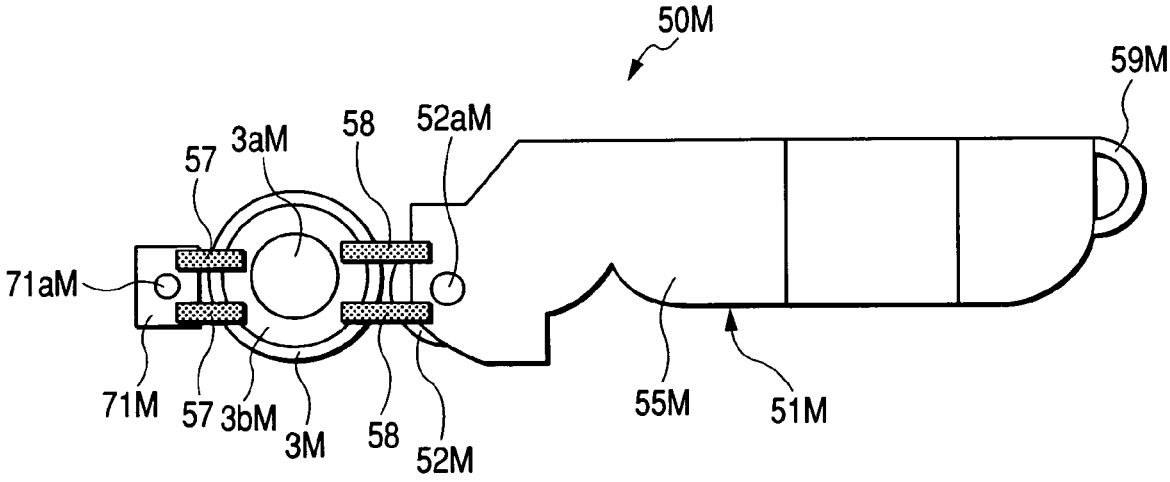
FIG. 3 is a side view showing the configuration of a process cartridge of the printer.

Also, as shown in FIG. 3, the developing devices 51M, 51C, 51Y and 51Bk are integrally connected to the photosensitive drums 3M, 3C, 3Y and 3Bk and the chargers 71M, 71C, 71Y and 71Bk via urethane elastomers 57 and 58 to configure process cartridges 50M, 50C, 50Y and 50Bk. It should be noted that, although only the process cartridge 50M is representatively shown in FIG. 4, the other process cartridges 50C, 50Y and 50Bk are similarly configured.

For this reason, the photosensitive drums 3M, 3C, 3Y and 3Bk and the chargers 71M, 71C, 71Y and 71Bk are simultaneously replaced when the developing devices 51M, 51C, 51Y and 51Bk are replaced. Also, as shown in FIG. 3, shafts 3*a*M, 3*a*C, 3*a*Y and 3*a*Bk of the photosensitive drums 3M, 3C, 3Y and 3Bk are rotatably supported by annular support plates 3*b*M, 3*b*C, 3*b*Y and 3*b*Bk. Additionally, the support plates 3*b*M, 3*b*C, 3*b*Y and 3*b*Bk are respectively connected to the chargers 71M, 71C, 71Y and 71Bk via the urethane elastomers 57 serving as first elastic bodies and to the developing device cases 55M, 55C, 55Y and 55Bk of the developing devices 51M, 51C, 51Y and 51Bk via the urethane elastomers 58 serving as second elastic bodies.

The urethane elastomers 57 and 58 are respectively connected to left and right side surfaces in two vertical rows. In a state where no external force is applied thereto, as shown in FIG. 3, the urethane elastomers 57 and 58 are disposed in a row with the chargers 71M, 71C, 71Y and 71Bk, the photosensitive drums 3M, 3C, 3Y and 3Bk and the developing devices 51M, 51C, 51Y and 51Bk. Also, in this state, the chargers 71M, 71C, 71Y and 71Bk, the photosensitive drums 3M, 3C, 3Y and 3Bk and the developing devices 51M, 51C, 51Y and 51Bk are disposed in the aforementioned row at predetermined intervals so that they do not contact each other.

Also, grip portions 59M, 59C, 59Y and 59Bk (only 59M are shown in FIG. 3) are disposed at both left and right ends of the front surface side of the developing device cases 55M, 55C, 55Y and 55Bk in the developing devices 51M, 51C, 51Y and 51Bk.

Figure 4B:
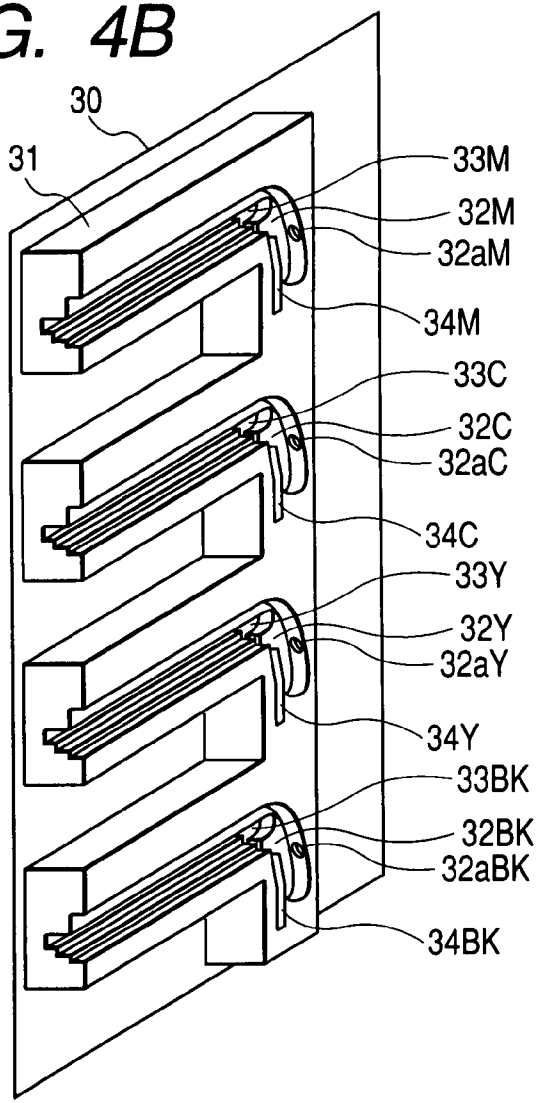
FIGS. 4A and 4B are a side view and a perspective view showing the configuration of guide grooves of the printer.
Figure 4A:
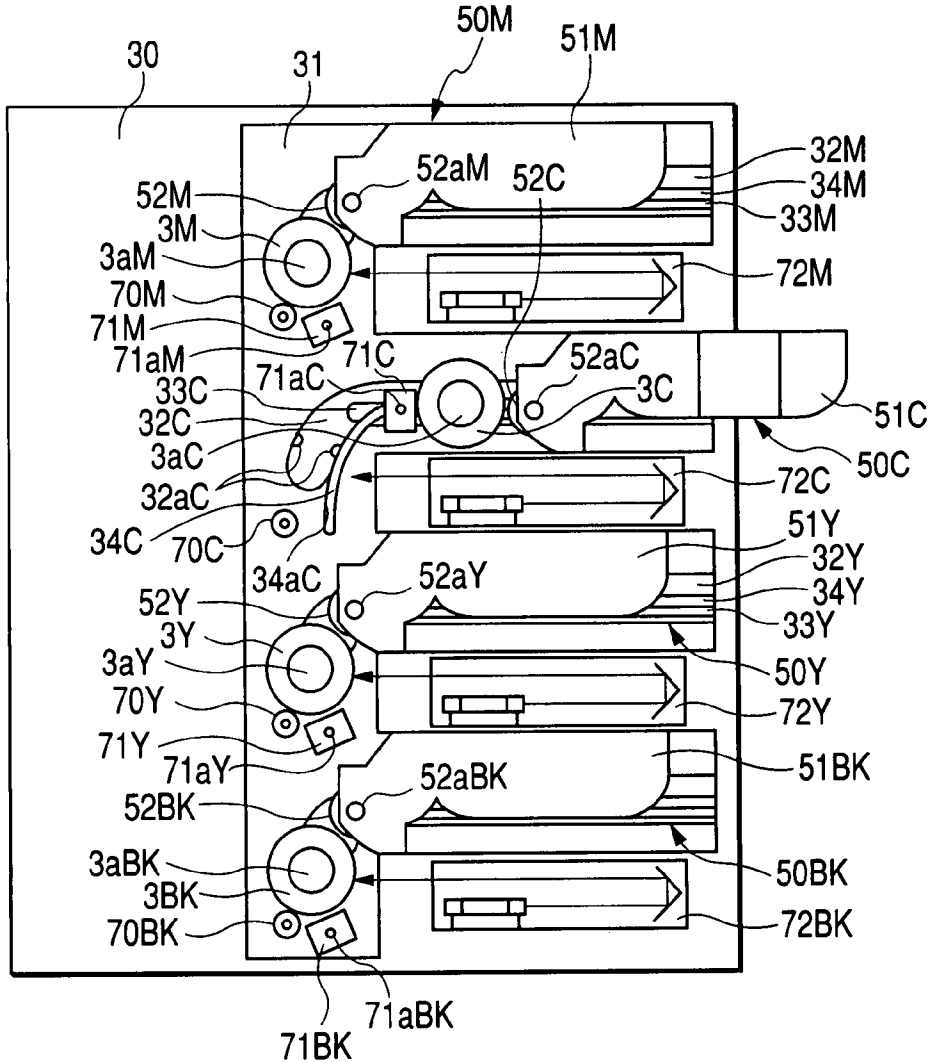

As shown in the side view of FIG. 4A and the perspective view of FIG. 4B, a support member 31 for supporting the process cartridges 50M, 50C, 50Y and 50Bk is fixed to left and right side panels 30 of the color laser printer 1. Additionally, guide grooves 32M, 32C, 32Y and 32Bk that guide the shafts 3*a*M, 3*a*C, 3*a*Y and 3*a*Bk of the photosensitive drums 3M, 3C, 3Y and 3Bk, guide grooves 33M, 33C, 33Y and 33Bk that guide shafts 52*a*M, 52*a*C, 52*a*Y and 52*a*Bk of the development rollers 52M, 52C, 52Y and 52Bk, and guide grooves 34M, 34C, 34Y and 34Bk that guide shafts 71*a*M, 71*a*C, 71*a*Y and 71*a*Bk that project from both left and right ends of the chargers 71M, 71C, 71Y and 71Bk are respectively formed in the support member 31.

Of the guide grooves 32M to 34Bk, the guide grooves 32M, 32C, 32Y and 32Bk are the deepest, the guide grooves 33M, 33C, 33Y and 33Bk are the next deepest, and the guide grooves 34M, 34C, 34Y and 34Bk are the least deepest. Also, although the guide grooves 33M, 33C, 33Y and 33Bk are formed horizontally across the length of the support member 31, the deep portions of the guide grooves 32M, 32C, 32Y and 32Bk curve downward near the leading ends, and the deep portions of the guide grooves 34M, 34C, 34Y and 34Bk curve further downward near the leading ends.

For this reason, when the cartridges are inserted deeply like the process cartridges 50M, 50Y and 50Bk shown in FIG. 4A, the photosensitive drums 3M, 3Y and 3Bk are disposed below the developing devices 51M, 51Y and 51Bk, and the chargers 71M, 71Y and 71Bk are disposed even further therebelow. However, when the developing device 51C is inserted or pulled out along the guide groove 33C like the process cartridge 50C shown in FIG. 4A, the developing device 51C, the photosensitive drum 3C and the charger 71C are disposed in a row as exemplified in FIG. 3.

Moreover, lock springs 32*a*M, 32*a*C, 32*a*Y and 32Bk and lock springs 34*a*M, 34*a*C, 34*a*Y and 34*a*Bk that fix the shafts 3*a*M, 3*a*C, 3*a*Y and 3*a*Bk of the photosensitive drums 3M, 3C, 3Y and 3Bk and the shafts 71*a*M, 71*a*C, 71*a*Y and 71*a*Bk of the chargers 71M, 71C, 71Y and 71Bk are disposed at leading ends of the guide grooves 32M, 32C, 32Y and 32Bk and the guide grooves 34M, 34C, 34Y and 34Bk (the lock springs 34*a*M, 34*a*Y and 34*a*Bk are not shown). The lock springs 32M to 34Bk are configured by wires being bent in a "<" shape, and position the shafts 3*a*M to 71*a*Bk in the leading ends of the guide grooves 32M to 34Bk.

Next, the operation of the color laser printer 1 of the present embodiment will be described. First, the photosensitive layers of the photosensitive drums 3M, 3C, 3Y and 3Bk are uniformly charged by the chargers 71M, 71C, 71Y and 71Bk. Next, the photosensitive layers are exposed in correspondence to magenta, cyan, yellow and black images by the exposure means 72M, 72C, 72Y and 72Bk. Then, magenta toner, cyan toner, yellow toner and black toner are respectively supplied onto the electrostatic latent images formed on the photosensitive layers of the photosensitive drums 3M, 3C, 3Y and 3Bk, and development of the magenta, cyan, yellow and black images is conducted. The magenta, cyan, yellow and black toner images formed in this manner are then transferred to the surface of the intermediate transfer body 5.

Next, toner remaining on the photosensitive drums 3M, 3C, 3Y and 3Bk after the transfer is temporarily retained by the cleaning rollers 70M, 70C, 70Y and 70Bk. The toner images of the colors are formed at slight time differentials to match the moving speed of the intermediate transfer body 5 and the positions of the photosensitive drums 3M, 3C, 3Y and 3Bk, and are transferred so as to be superposed on the intermediate transfer body 5.

The four-color toner image formed on the intermediate transfer body 5 in this manner is transferred, at the position where the secondary transfer roller 63 and the intermediate transfer body 5 contact, onto the paper P supplied from the paper supply unit 9. Then, the toner image is fixed on the paper P in the fixing unit 8 and discharged onto the paper discharge tray 10. In this manner, a four-color color image is formed.

Also, when any of the process cartridges 50M, 50C, 50Y and 50Bk (e.g., the process cartridge 50C) is to be replaced, the front cover 20 is opened, the grip portions 59C are gripped and the developing device 51C is pulled out horizontally along the guide grooves 33C. In so doing, the development roller 52C and the photosensitive drum 3C are separated until the urethane elastomers 58 stretch to the length shown in FIG. 3. Then, due to tensile force from the urethane elastomers 58, the shaft 3*a*C of the photosensitive drum 3C crosses over the lock spring 32*a*C and moves along the guide grooves 32C.

In accompaniment therewith, the shaft 71*a*C of the charger 71C also crosses over the lock spring 34*a*C and moves along the guide grooves 34C. The photosensitive drum 3C and the charger 71C first move diagonally upward along the guide grooves 32C and 34C, and then move to a position at which they are not horizontally in line with the exposure means 72C. Then, as shown in FIG. 4A, after the developing device 51C, the photosensitive drum 3C and the charger 71C have been disposed in a row, the entire process cartridge 50C can be horizontally pulled out.

When the process cartridge 50C is to be loaded, the developing device 51C, the photosensitive drum 3C and the charger 71C are first disposed in a row due to the action of the urethane elastomers 57 and 58 (see FIG. 3). When the shafts 71*a*C, 3*a*C and 52*a*C successively engage with the guide grooves 34C, 32C and 33C and the entire process cartridge 50C is horizontally pushed, the charger 71C and the photosensitive drum 3C are guided midway to the guide grooves 34*c* and 32C and move downward. Then, when the developing device 51C is pushed further, the shafts 71*a*C and 3*a*C are pushed via the urethane elastomers 57 and 58 and cross over the lock springs 34*a*C and 32*a*C. The shafts 71*a*C and 3*a*C of the charger 71C and the photosensitive drum 3C are positioned at the leading ends of the guide grooves 34C and 32C, and the photosensitive drum 3C and the charger 71C are disposed in positions horizontally in line with the exposure means 72C.

From the start of insertion of the process cartridge 50C to now, the charger 71C, the photosensitive drum 3C and the developing device 52C are retained, by the action of the urethane elastomers 57 and 58, so that they do not contact each other. When the front cover 20 is closed after the above-described operation, the spring member 21C pushes the developing device 51C. Thus, the shaft 52*a*C of the development roller 52C is positioned at the leading end of the guide groove 33C, and the peripheral surface of the development roller 52C and peripheral surface of the photosensitive drum 3C come into contact.

It should be noted that the same is true in the case of replacing the process cartridges 50M, 50Y and 50Bk. Also, simultaneously replacing the chargers 71M, 71C, 71Y and 71Bk, the photosensitive drums 3M, 3C, 3Y and 3Bk and the developing devices 51M, 51C, 51Y and 51Bk in this manner is extremely effective in maintaining the excellent image quality of the color laser printer 1.

In the present embodiment, at the time of loading and unloading the process cartridges 50M, 50C, 50Y and 50Bk, the photosensitive drums 3M, 3C, 3Y and 3Bk and the chargers 71M, 71C, 71Y and 71Bk are disposed in positions in line along the loading/unloading direction and the relative positions between the chargers 71M, 71C, 71Y and 71Bk, the photosensitive drums 3M, 3C, 3Y and 3Bk and the developing devices 51M, 51C, 51Y and 51Bk are changed so that the process cartridges 50M, 50C, 50Y and 50Bk can be loaded and unloaded. For this reason, the process cartridges 50M, 50C, 50Y and 50Bk do not interfere with the exposure means 72M, 72C, 72Y and 72Bk at the time of loading and unloading. Thus, replacement of the process cartridges 50M, 50C, 50Y and 50Bk can be conducted without moving the exposure means 72M, 72C, 72Y and 72Bk, so that color shifting can be excellently prevented.

Also, because the photosensitive drums 3M, 3C, 3Y and 3Bk are also positioned by the lock springs 32*a*M, 32*a*C, 32*a*Y and 32*a*Bk, color shifting can be more excellently prevented. Moreover, because the color laser printer 1 of the present embodiment is a so-called tandem-system multicolor image forming apparatus, it is suited for increases in the speed of image formation.

Moreover, at the time of replacing the process cartridges 50M, 50C, 50Y and 50Bk, the chargers 71M, 71C, 71C and 71Bk, the photosensitive drums 3M, 3C, 3Y and 3Bk and the developing devices 51M, 51C, 51Y and 51Bk move in a state where they do not contact one another. Additionally, the chargers 71M, 71C, 71Y and 71Bk and the developing devices 51M, 51C, 51Y and 51Bk relatively move around the shafts 3*a*M, 3*a*C, 3*a*Y and 3*a*Bk with respect to the photosensitive drums 3M, 3C, 3Y and 3Bk. For this reason, in the present embodiment, the peripheral surfaces of the photosensitive drums 3M, 3C, 3Y and 3Bk can be excellently prevented from being damaged. Moreover, because the respective portions of the process cartridges 50M, 50C, 50Y and 50Bk are guided along the guide grooves 32M to 34Bk, the respective portions can be more excellently prevented from abutting against and damaging other members such as the exposure means 72M, 72C, 72Y and 72Bk.

Also, in the present embodiment, because the process cartridges 50M, 50C, 50Y and 50Bk are loaded and unloaded in directions substantially orthogonal to the shafts 3*a*M, 3*a*C, 3*a*Y and 3*a*Bk, the configuration of shaft-receiving portions can be simplified and the manufacturing costs of the color laser printer 1 can be reduced in comparison to a case where the process cartridges are loaded and unloaded along the shafts 3*a*M, 3*a*C, 3*a*Y and 3*a*Bk.

Moreover, in the present embodiment, the relative positions of the chargers 71M, 71C, 71Y and 71Bk, the photosensitive drums 3M, 3C, 3Y and 3Bk and the developing devices 51M, 51C, 51Y and 51Bk of the pulled-out process cartridges 50M, 50C, 50Y and 50Bk are retained in a positional relation, by the urethane elastomers 57 and 58, immediately after being pulled out. Thus, the process cartridges 50M, 50C, 50Y and 50Bk can be loaded in the color laser printer 1 without changing the positional relation of the respective portions, so that replacement becomes easier.

In the tandem system, as described above, the photosensitive drums 3M, 3C, 3Y and 3Bk are positioned in the vicinity of the center of the color laser printer 1 mainframe, between the exposure means 72M, 72C, 72Y and 72Bk and the intermediate transfer body 5, so that replacement of the photosensitive drums 3M, 3C, 3Y and 3Bk is difficult. However, by disposing the grip portions 59M, 59C, 59Y and 59Bk on the process cartridges 50M, 50C, 50Y and 50Bk, the photosensitive drums 3M, 3C, 3Y and 3Bk can be loaded and unloaded together, whereby it becomes possible to more easily replace the photosensitive drums 3M, 3C, 3Y and 3Bk.

It should be noted that, in the above-described embodiment, the developing devices 51M, 51C, 51Y and 51Bk and the chargers 71M, 71C, 71Y and 71Bk correspond to process means, and the shafts 3*a*M, 3*a*C, 3*a*Y, 3*a*Bk, 52*a*M, 52*a*C, 52*a*Y, 52*a*Bk, 71*a*M, 71*a*C, 71*a*Y and 71*a*Bk correspond to guided portions.

Also, the present invention is not limited to the above-described embodiment and can be variously implemented in a range that does not deviate from the gist of the invention. For example, although the developing devices 51M, 51C, 51Y and 51Bk and the chargers 71M, 71C, 71Y and 71Bk were integrally connected to the photosensitive drums 3M, 3C, 3Y and 3Bk to configure the process cartridges 50M, 50C, 50Y and 50Bk in the above-described embodiment, the chargers 71M, 71C, 71Y and 71Bk may be separately disposed, and the cleaning rollers 70M, 70C, 70Y and 70Bk serving as process means may be integrated.

Moreover, a configuration that is the same as that of the process cartridges 50M, 50C, 50Y and 50Bk of the present embodiment can also be applied to a monochromatic image forming apparatus. Also, the urethane elastomers 57 and 58 may be connected to the cases of the photosensitive drums 3M, 3C, 3Y and 3Bk, and the guide members may also be rails instead of grooves.

While the invention has been described in conjunction with the specific embodiments described above, many equivalent alternatives, modifications and variations may become apparent to those skilled in the art when given this disclosure. Accordingly, the exemplary embodiments of the invention as set forth above are considered to be illustrative and not limiting. Various changes to the described embodiments may be made without departing from the spirit and scope of the invention.

What is claimed is:

1. An image forming apparatus, comprising:

a mainframe including a first guide portion and a second guide portion, each of which is formed horizontally across an inside of the mainframe, and the second guide portion including a horizontal portion and a downwardly curved portion at an end; and a process cartridge loadable in and unloadable from the mainframe, the process cartridge comprising:

a cartridge frame configured to contain a developer;

a photosensitive body; and a developing roller disposed in the cartridge frame, the developing roller being configured to face the photosensitive body;

wherein:

the photosensitive body and the cartridge frame are connected such that positions of the photosensitive body and the cartridge frame are movable relative to one another while the process cartridge is being loaded in and unloaded from the mainframe;

the cartridge frame is guided by and stops at the end of the first guide portion while the process cartridge is being loaded in the mainframe, the photosensitive body is guided by the horizontal portion and the downwardly curved portion of the second guide portion and stops at the end of the downwardly curved portion of the second guide portion while the process cartridge is loaded in the mainframe, the photosensitive body is horizontally in line with an exposure unit of the mainframe when the process cartridge is loaded in the mainframe and the photosensitive body is positioned at the end of the downwardly curved portion of the second guide portion; and the photosensitive body is not horizontally in line with the exposure unit while the process cartridge is being unloaded from the mainframe and the photosensitive body is guided by the horizontal portion of the second guide portion.

2. The image forming apparatus as claimed in claim 1, further comprising a plurality of the process cartridges, wherein each photosensitive body comprises a photosensitive drum corresponding to one of a plurality of colors different from the other photosensitive drums.

3. The image forming apparatus as claimed in claim 1, wherein the processing device faces a surface of the photosensitive body and acts on the photosensitive body without contacting.

4. The image forming apparatus as claimed in claim 1, wherein the processing device contacts a surface of the photosensitive body while acting on the photosensitive body; and the processing device is separated from the photosensitive body at the time the process cartridge is loaded and unloaded.

5. The image forming apparatus as claimed in claim 1, wherein the processing device includes one of a charging unit that uniformly charges a surface of the photosensitive body prior to the formation of the electrostatic latent image, a developing unit that supplies a charged developing agent onto a surface of the photosensitive body on which the electrostatic latent image is formed to develop the electrostatic latent image, and a cleaning unit that removes developing agent remaining on the surface of photosensitive body after a transfer of the developing agent is performed.

6. The image forming apparatus according to claim 1, wherein the processing device is a developing unit that supplies a charged developing agent onto the surface of photosensitive body on which the electrostatic latent image is formed to develop the electrostatic latent image; and the process cartridge includes a grip portion disposed on the developing unit.

7. The image forming apparatus as claimed in claim 1, wherein the process cartridge includes an elastic body disposed between the photosensitive body and the processing device so that, when the process cartridge is removed from the mainframe, the relative positions can assume a predetermined positional relation where the process cartridge is easily loaded in the mainframe.

8. The image forming apparatus as claimed in claim 7, wherein the predetermined positional relation is a positional relation immediately after the process cartridge has been taken out from the mainframe.

9. The image forming apparatus as claimed in claim 7, wherein the processing device includes a charging unit that uniformly charges a surface of the photosensitive body prior to the formation of the electrostatic latent image and a developing unit that supplies a charged developing agent onto the surface of the photosensitive body on which the electrostatic latent image is formed to develop the electrostatic latent image; and the elastic body includes a first elastic body that connects the charging unit with the photosensitive body and a second elastic body that connects the developing unit with the photosensitive body.

10. The image forming apparatus as claimed in claim 1, wherein the photosensitive body includes a photosensitive drum; and the processing device relatively moves around an axial line of the photosensitive drum.

11. The image forming apparatus as claimed in claim 1, wherein the photosensitive body includes a photosensitive drum; and the process cartridge is loaded and unloaded in a direction substantially orthogonal to an axial line of the photosensitive drum.

12. The image forming apparatus according to claim 1, wherein the developing roller contacts the photosensitive body when the process cartridge is loaded in the mainframe.

13. The image forming apparatus according to claim 12, wherein the developing roller separates from the photosensitive body while the process cartridge is loaded in and unloaded from the mainframe.

14. The image forming apparatus according to claim 1, wherein the process cartridge further comprises:

a first elastic element that is transformable between a first original shape and a first transformed shape, the first elastic element connecting the photosensitive body and the cartridge frame.

15. The image forming apparatus according to claim 14, wherein the first elastic element is transformable while the process cartridge is loaded in and unloaded from the mainframe.

16. The image forming apparatus according to claim 15, wherein the first elastic element is formed in the first transformed shape when the process cartridge is loaded in the mainframe.

17. The image forming apparatus according to claim 15, wherein the first elastic element is formed in the first original shape when the process cartridge is unloaded from the mainframe.

18. The image forming apparatus according to claim 14, wherein the developing roller contacts the photosensitive body when the first elastic element is transformed in the first transformed shape.

19. The image forming apparatus according to claim 18, wherein the developing roller separates from the photosensitive body the first elastic element is transformed in the first original shape.

20. The image forming apparatus according to claim 14, wherein the first elastic element is formed of an elastomeric material.

21. The image forming apparatus according to claim 1, wherein the process cartridge further comprises:

a charging unit that charges a surface of the photosensitive body, relative positions of the photosensitive body and the charging unit are movable while the process cartridge is loaded in and unloaded from the mainframe.

22. The image forming apparatus according to claim 21, wherein the process cartridge further comprises:

a second elastic element that is transformable between a second original shape and a second transformed shape, the second elastic element connecting the photosensitive body and the charging unit.

23. The image forming apparatus according to claim 22, wherein the second elastic element is transformable while the process cartridge is loaded in and unloaded from the mainframe.

24. The image forming apparatus according to claim 23, wherein the second elastic element is transformed in the second transformed shape when the process cartridge is loaded in the mainframe.

25. The image forming apparatus according to claim 23, wherein the second elastic element is formed in the second original shape when the process cartridge is unloaded from the mainframe.

26. The image forming apparatus according to claim 22, wherein the second elastic element is formed of an elastomeric material.

27. The image forming apparatus according to claim 1, wherein the process cartridge further comprises:

a first elastic element that is transformable between a first original shape and a first transformed shape, the first elastic element connecting the photosensitive body and the cartridge frame, wherein the first elastic element is transformed in the first transformed shape while the photosensitive body is loaded in the mainframe.

28. The image forming apparatus according to claim 27, wherein the process cartridge further comprising:

a charging unit that charges a surface of the photosensitive body; and a second elastic element that is transformable between a second original shape and a second transformed shape, the second elastic element connecting the photosensitive body and the charging unit, wherein the second elastic element is transformed in the second transformed shape while the second guided portion is guided by the first guide portion.

29. The image forming apparatus of claim 1, wherein:

the mainframe further comprises a third guide portion;

the process cartridge further comprises a charger; and the charger stops at the third guide portion when the process cartridge is loaded in the mainframe.

30. A process cartridge, comprising:

a cartridge frame configured to contain a developer;

a photosensitive body;

a developing roller disposed in the cartridge frame, the developing roller being configured to face the photosensitive body; and a first elastic element transformable between a first original shape and a first transformed shape, wherein the first elastic element is attached to the photosensitive body and to the cartridge frame.

31. The process cartridge of claim 30, wherein:

relative positions of the photosensitive body and the developing roller are changeable when the process cartridge is loaded in and unloaded from the image forming apparatus; and at least one of the photosensitive body and the developing roller have a first guided portion that fits with a second guide portion that is provided in the image forming apparatus.

32. The process cartridge as claimed in claim 31, wherein the developing roller faces a surface of the photosensitive body and acts on the photosensitive body without contacting.

33. The process cartridge as claimed in claim 31, wherein the developing roller contacts a surface of the photosensitive body while acting on the photosensitive body; and the developing roller is separated from the photosensitive body at the time the process cartridge is loaded and unloaded.

34. The process cartridge as claimed in claim 31, further comprising one of:

a charging unit that uniformly charges a surface of the photosensitive body prior to the formation of an electrostatic latent image thereon; and a cleaning unit that removes developing agent remaining on the surface of the photosensitive body after a transfer of the developing agent is performed.

35. The process cartridge as claimed in claim 31, further comprising a grip portion disposed on the cartridge frame.

36. The process cartridge as claimed in claim 31, wherein the first elastic element is configured so that, when the process cartridge is removed from the image forming apparatus, the relative positions can assume a predetermined positional relation in which the first elastic is in the first original shape, such that the process cartridge is easily loaded in the image forming apparatus.

37. The process cartridge as claimed in claim 36, wherein the predetermined positional relation is a positional relation immediately after the process cartridge has been taken out from the image forming apparatus.

38. The process cartridge as claimed in claim 36, further comprising:

a charging unit that uniformly charges a surface of the photosensitive body prior to the formation of an electrostatic latent image; and a second elastic element that connects the charging unit with the photosensitive body.

39. The process cartridge as claimed in claim 31, wherein:

the photosensitive body includes a photosensitive drum; and when the first elastic element transforms from the first original shape to the first transformed shape, the processing device relatively moves around an axial line of the photosensitive drum.

40. The process cartridge as claimed in claim 31, wherein:

the photosensitive body includes a photosensitive drum; and the process cartridge is loaded and unloaded in a direction substantially orthogonal to an axial line of the photosensitive drum.

41. The process cartridge according to claim 30, further comprising:

a charging unit that charges a surface of the photosensitive body; and a second elastic element that is transformable between a second original shape and a second transformed shape, the second elastic element connecting the photosensitive body and the charging unit.

42. The process cartridge according to claim 41, wherein the second elastic element is formed of a rubber material.

43. The process cartridge according to claim 30, wherein the first elastic element is formed of a rubber material.

44. The process cartridge according to claim 30, wherein one end of the first elastic element is directly attached to the photosensitive body.

* * * * *